US008057025B2

(12) United States Patent
Hirota

(10) Patent No.: US 8,057,025 B2
(45) Date of Patent: Nov. 15, 2011

(54) INKJET HEAD

(75) Inventor: Atsushi Hirota, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 248 days.

(21) Appl. No.: 12/408,465

(22) Filed: Mar. 20, 2009

(65) Prior Publication Data

US 2009/0237455 A1 Sep. 24, 2009

(30) Foreign Application Priority Data

Mar. 24, 2008 (JP) ..... 2008-075061

(51) Int. Cl.
*B41J 2/175* (2006.01)
*B41J 2/18* (2006.01)

(52) U.S. Cl. ..... 347/85; 347/89

(58) Field of Classification Search ..... 347/85, 347/89

See application file for complete search history.

(56) References Cited

U.S. PATENT DOCUMENTS

2006/0103700 A1* 5/2006 Taira ..... 347/85
2007/0229602 A1 10/2007 Taira et al.
2007/0229610 A1 10/2007 Taira et al.

FOREIGN PATENT DOCUMENTS

JP 2005-125670 A 5/2005
JP 2007-268844 A 10/2007
JP 2007-268868 A 10/2007

* cited by examiner

*Primary Examiner* — Geoffrey Mruk
(74) *Attorney, Agent, or Firm* — Baker Botts L.L.P.

(57) ABSTRACT

An inkjet head may include a main-body block, which may include a reservoir configured to store ink, an ink supply port configured to supply the ink to the reservoir, and a plurality of nozzles in fluid communication with the reservoir via an ink flow path. The inkjet head may include a supply valve mechanism attached to the main-body block and configured to selectively set the ink supply port in one of a sealed state and an open state. The inkjet head may further include an attachment unit configured to be removably attached to the main-body block. The attachment unit may include a supply channel configured to supply the ink to the ink supply port. The supply valve mechanism may set the ink supply port in the sealed state when the attachment unit is detached from the main-body block, and set the ink supply port in the open state when the attachment unit is attached to the main-body block.

21 Claims, 12 Drawing Sheets

INKJET HEAD

CROSS REFERENCE TO RELATED APPLICATION

This application claims priority to Japanese Patent Application No. 2008-075061, filed Mar. 24, 2008, the entire subject matter and disclosure of which is incorporated herein by reference.

BACKGROUND OF THE DISCLOSURE

1. Field of the Disclosure

The present application relates to inkjet heads that eject ink onto recording medium.

2. Description of the Related Art

A known inkjet head installed in an inkjet printer that performs printing by ejecting ink droplets onto a recording medium is provided with a channel unit and a reservoir unit. Specifically, the channel unit has a common ink chamber and individual ink channels extending from the common ink chamber to nozzles, and the reservoir unit has an ink reservoir communicating with the common ink chamber and an ink supply port that supplies ink to the ink reservoir. In the inkjet head, the ink is supplied to the ink reservoir of the reservoir unit via an ink tube connected to the ink supply port.

When storing or transporting the above-described inkjet head by itself, the ink supply port thereof needs to be sealed to inhibit the ink from drying out or from leaking through the ink supply port. On the other hand, when using the inkjet head by attaching it to the printer, the ink supply port needs to be opened for ink supply. Therefore, when storing or transporting the above-described inkjet head by itself, the ink supply port is sealed with a detachable sealing member.

For this reason, when inspecting the above-described inkjet head during the manufacturing process thereof or when shipping the inkjet head, the sealing member needs to be checked in addition to the components constituting the inkjet head, resulting in complicated quality control.

SUMMARY OF THE INVENTION

A need has arisen for an inkjet head that may maintain the ink communicating port in a sealed state without requiring an additional component.

According to an embodiment of the invention, an inkjet head may include a main-body block, which may include a reservoir configured to store ink, an ink supply port configured to supply the ink to the reservoir, and a plurality of nozzles in fluid communication with the reservoir via an ink flow path. The inkjet head may include a supply valve mechanism attached to the main-body block and configured to selectively set the ink supply port in one of a sealed state and an open state. The inkjet head may further include an attachment unit configured to be removably attached to the main-body block. The attachment unit may include a supply channel configured to supply the ink to the ink supply port. The supply valve mechanism may set the ink supply port in the sealed state when the attachment unit is detached from the main-body block, and set the ink supply port in the open state when the attachment unit is attached to the main-body block.

According to another embodiment, an inkjet head may include a main-body block, which may include a reservoir configured to store ink, an ink drain port configured to drain the ink from the reservoir, and a plurality of nozzles in fluid communication with the reservoir via an ink flow path. The inkjet head may include a drain valve mechanism attached to the main-body block and configured to selectively set the ink drain port in one of a sealed state and an open state. The inkjet head may further include an attachment unit configured to be removably attached to the main-body block. The attachment unit may include a drainage channel configured to drain the ink from the ink drain port. The drain valve mechanism may set the ink drain port in the sealed state when the attachment unit is detached from the main-body block, and set the ink drain port in the open state when the attachment unit is attached to the main-body block.

According to another embodiment, an inkjet head may include a main-body block, which may include a reservoir configured to store ink, an ink supply port configured to supply the ink to the reservoir, an ink drain port configured to drain the ink from the reservoir, and a plurality of nozzles in fluid communication with the reservoir via an ink flow path. The inkjet head may include a supply valve mechanism attached to the main-body block and configured to selectively set the ink supply port in one of a sealed state and an open state and a drain valve mechanism attached to the main-body block and configured to selectively set the ink drain port in one of a sealed state and an open state. The inkjet head may further include an attachment unit configured to be removably attached to the main-body block. The attachment unit may include a supply channel configured to supply the ink to the ink supply port and a drainage channel configured to drain the ink from the ink drain port. When the attachment unit is detached from the main-body block, the supply valve mechanism may set the ink supply port in the sealed state and the drain valve mechanism may set the ink drain port in the sealed state. When the attachment unit is attached to the main-body block, the supply valve mechanism may set the ink supply port in the open state and the drain valve mechanism may set the ink drain port in the open state.

Other objects, features and advantages will be apparent to those skilled in the art from the following detailed description and accompanying drawings.

BRIEF DESCRIPTION OF THE DRAWINGS

Embodiments of inkjet heads are described with reference to the accompanying drawings, which are given by way of example only, and are not intended to limit the invention.

DESCRIPTION OF THE EMBODIMENTS

Figure 1:
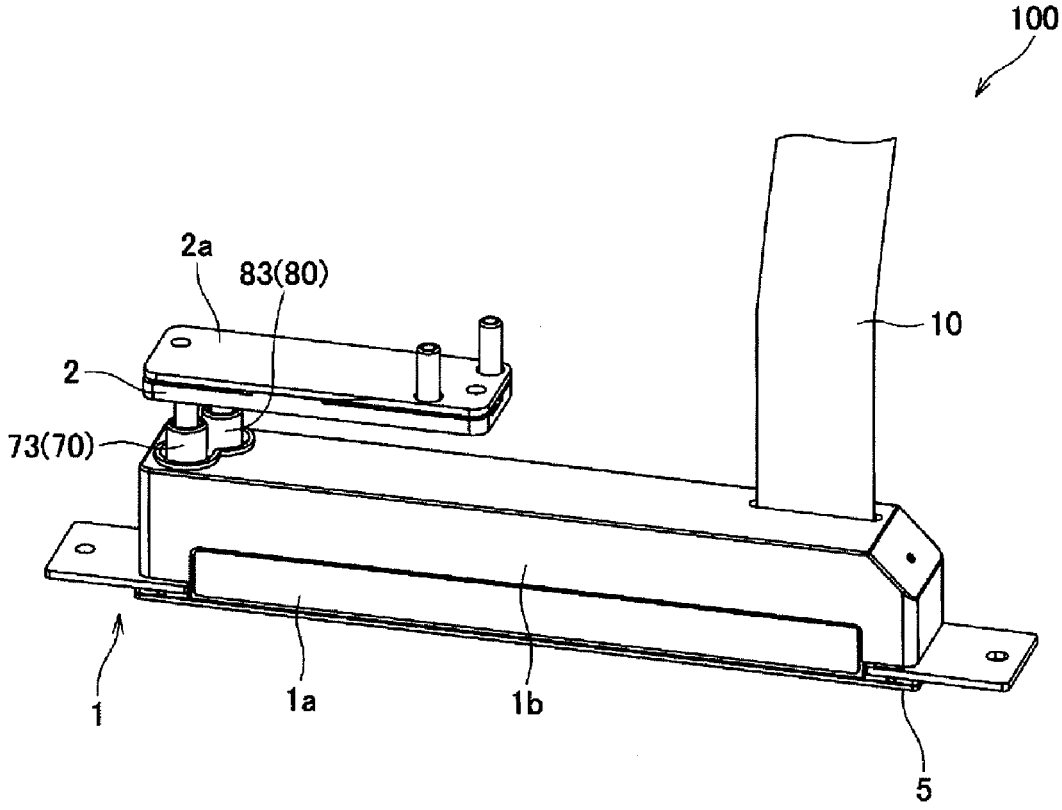
FIG. 1 is a schematic perspective view of an inkjet head according to an embodiment of the disclosed subject matter.

Referring to FIG. 1, an inkjet head 100 according to an embodiment may be installed in an inkjet printer and may be configured to eject ink on a sheet. The inkjet head 100 may be entirely elongated in one direction in plan view. In this embodiment, the longitudinal direction of the elongated inkjet head 100 in plan view may be the main scanning direction, whereas the direction orthogonal to the main scanning direction in plan view may be the sub scanning direction. The direction in which ink is ejected from the inkjet head 100 and which is orthogonal to both the main scanning direction and the sub scanning direction may be defined as the downward direction, and the direction opposite to the downward direction may be defined as the upward direction.

Figure 2:
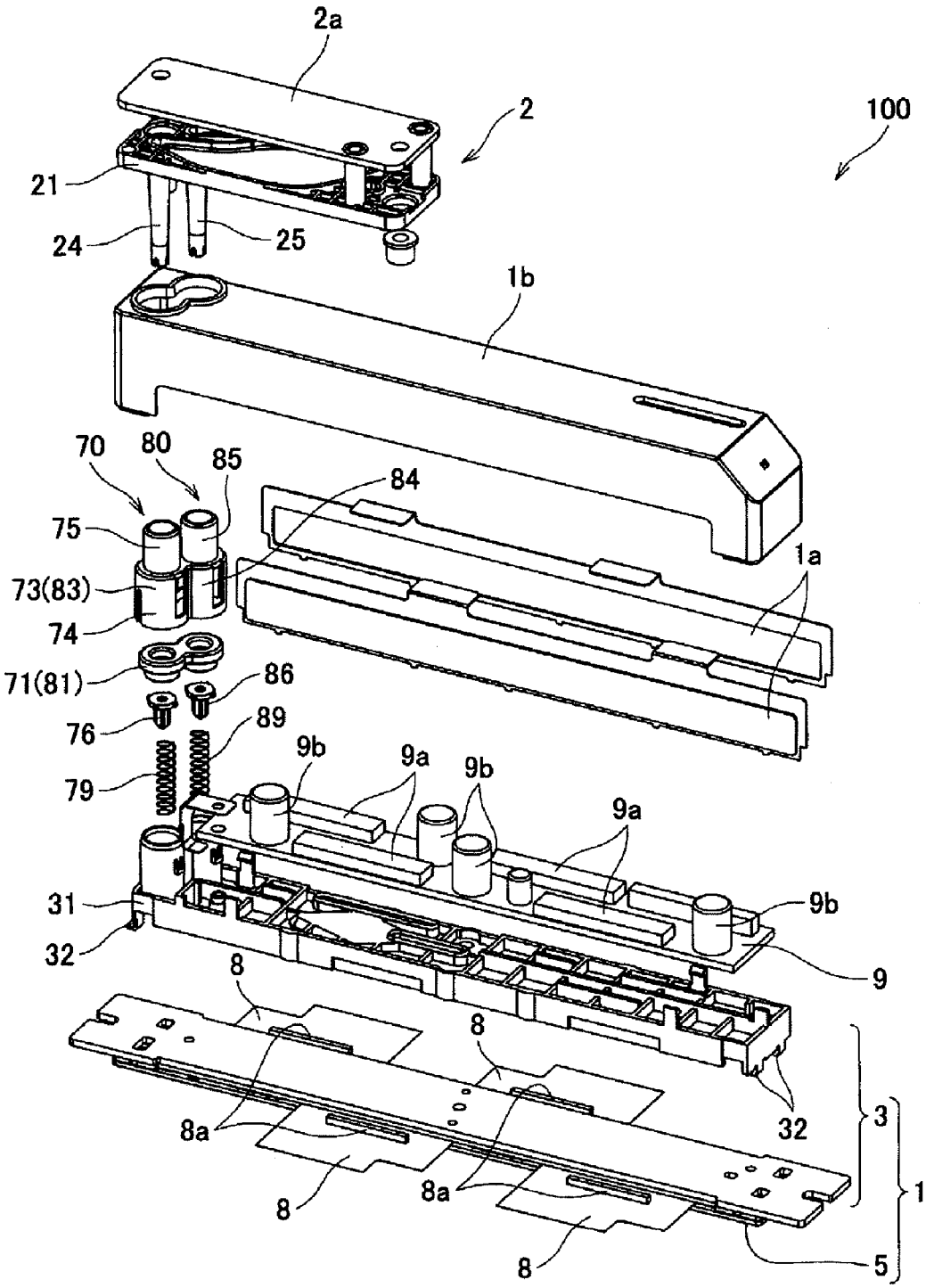
FIG. 2 is an exploded perspective view of the inkjet head according to an embodiment of the disclosed subject matter.
Figure 3:
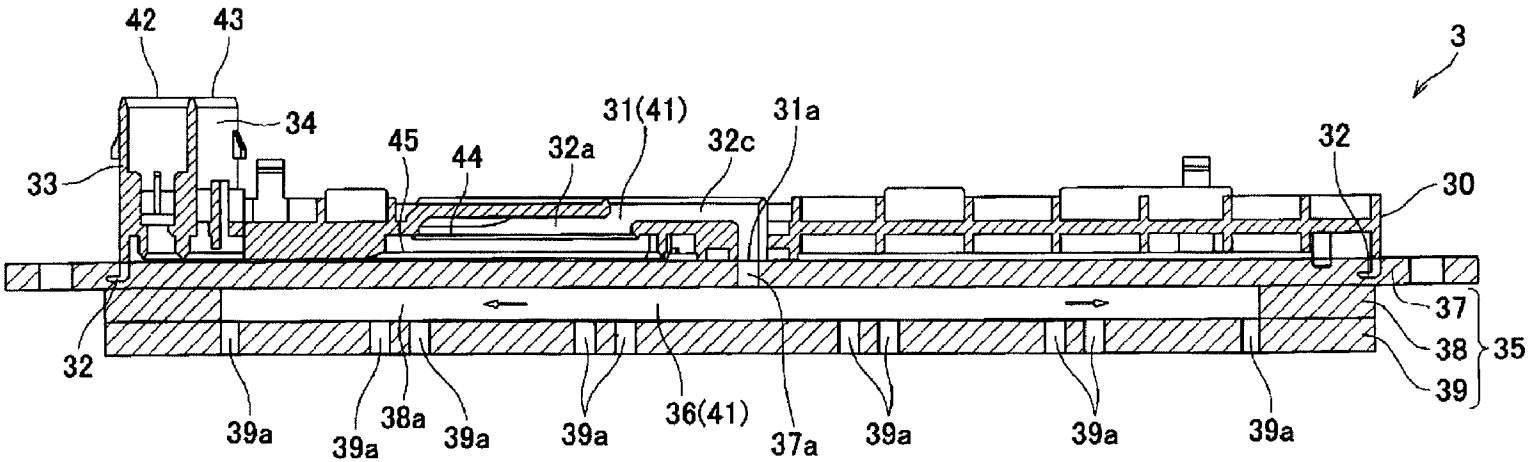
FIG. 3 is a cross-sectional view taken along a main scanning direction of a reservoir unit according to an embodiment of the disclosed subject matter.
Figure 7:
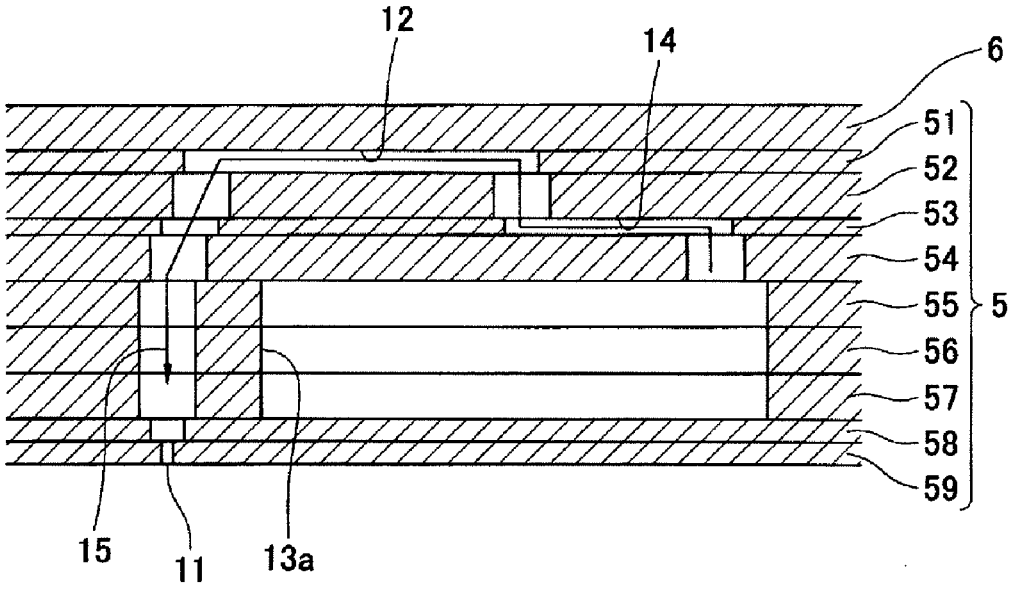
FIG. 7 is a partial cross-sectional view of the channel unit according to an embodiment of the disclosed subject matter.

Referring to FIG. 2, the inkjet head 100 may comprise a main-body block 1, which comprises a reservoir unit 3 and a channel unit 5, and an attachment unit 2 detachably attached to the main-body block 1. Referring to FIG. 3, specifically, the reservoir unit 3 may have a reservoir 41 that temporarily stores ink. Referring to FIG. 7, the channel unit 5 may have individual ink channels 15 communicating with a plurality of nozzles 11 and may receive the ink from the reservoir unit 3 positioned above the channel unit 5. Referring again to FIG. 2, the upper surface of the attachment unit 2 may be covered with a cover 2*a*. Referring again to FIG. 3, the reservoir unit 3 may have an ink supply port 42 for supplying ink to the reservoir 41 and an ink drain port 43 for draining the ink from the reservoir 41. A supply-valve mechanism 70 and a drain-valve mechanism 80 may be respectively attached to the ink supply port 42 and the ink drain port 43.

Figure 6:
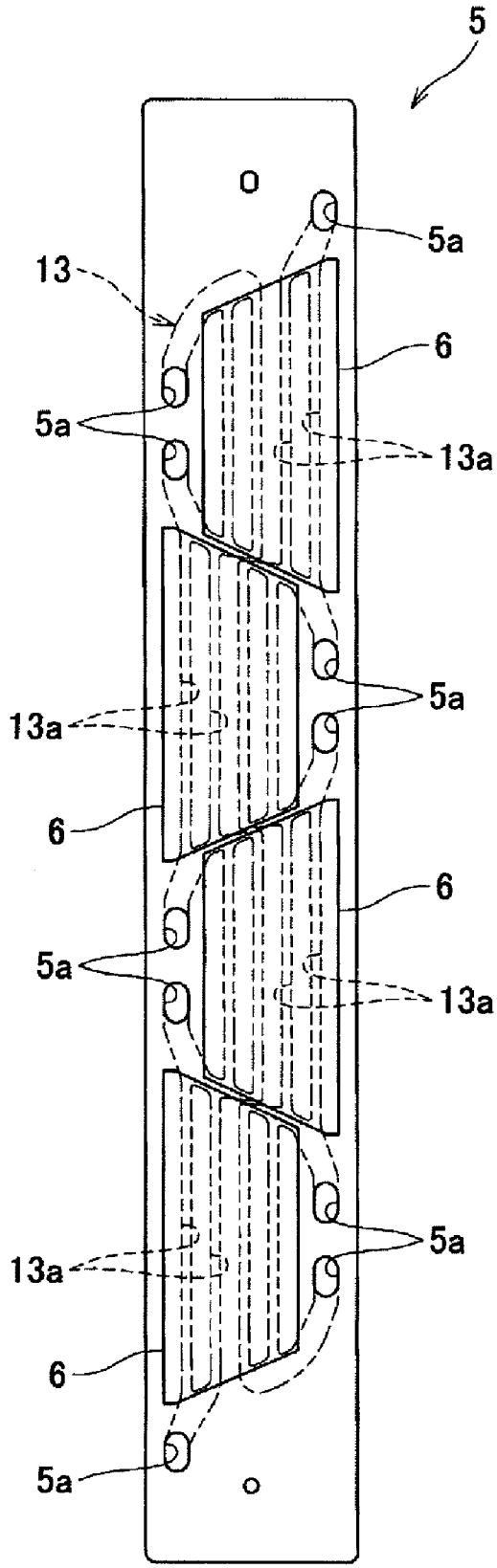
FIG. 6 is a plan view of a channel unit according to an embodiment of the disclosed subject matter.

Referring to FIG. 6, a plurality of, e.g., four, actuator units 6 may be positioned on the upper surface of the channel unit 5. Each actuator unit 6 may have a flexible printed circuit ("FPC") 8 bonded thereon, which functions as an electric wiring member. A board 9 having mounted thereon electronic components such as connectors 9*a* and capacitors 9*b* may be positioned at an upper section of the main-body block 1. The FPCs 8 may extend outward from between the channel unit 5 and the reservoir unit 3 and may be routed upward along the side surfaces of the reservoir unit 3 so as to be connected to the corresponding connectors 9*a* on the board 9. Each FPC 8 may have a driver integrated-circuit ("IC") 8*a* mounted thereon at an intermediate position between the actuator units 6 and the board 9.

The board 9 may be electrically connected via a flexible flat cable ("FFC") 10 to a control device (not shown) that controls the entire printer in which the inkjet head 100 is installed. Thus, a signal from the control device may be relayed by the board 9 to the driver ICs 8*a* via the FPCs 8 such that a drive signal output from the driver ICs 8*a* is supplied to the actuator units 6. The board 9 and the FPCs 8 may be covered by side covers 1*a* and a head cover 1*b*.

Referring to FIG. 3, the reservoir unit 3 may have a multi-layer structure including an upper reservoir body 30 extending in the main scanning direction and three stacked plates 37 to 39 extending in the main scanning direction. The three stacked plates 37 to 39 may constitute a lower reservoir body 35. For illustrative purposes, FIG. 3 shows the vertical direction at an enlarged scale, and also illustrates channels that are actually not viewable in a sectional view taken along a single line.

Figure 4A:
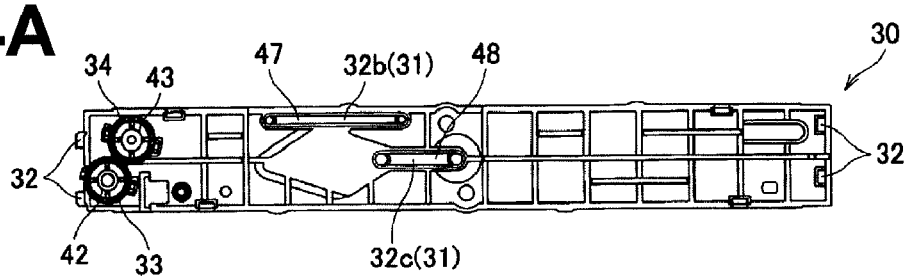
FIG. 4A is a plan view of the upper reservoir body, as viewed from above, according to an embodiment of the disclosed subject matter.
Figure 4B:
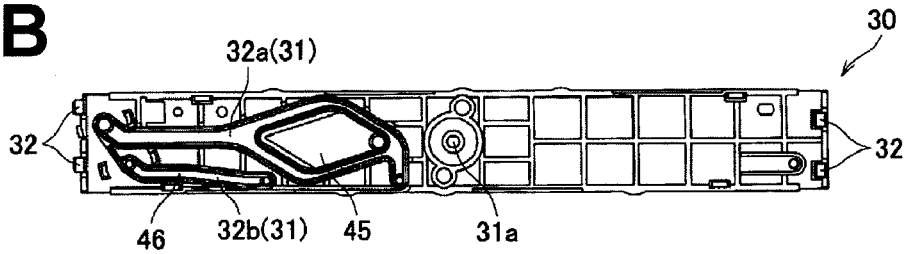
FIG. 4B is a plan view of the upper reservoir body, as viewed from below, according to an embodiment of the disclosed subject matter.

Referring to FIGS. 4A and 4B, the upper reservoir body 30 may be composed of synthetic resin such as polyethylene terephthalate resin or polypropylene resin. The longitudinal ends of the upper reservoir body 30 may include a plurality of, e.g., two, claws 32 that are to be engaged with openings 37*b* formed in the uppermost plate 37 of the lower reservoir body 35. With this engagement, the upper reservoir body 30 may be fixed to the upper surface of the lower reservoir body 35.

The upper reservoir body 30 may have an upper reservoir 31 formed therein. The upper reservoir 31 may extend from a midsection of the upper reservoir body 30 in the longitudinal direction thereof (which will simply be referred to as a "midsection" hereinafter) to one end of the upper reservoir body 30 in the longitudinal direction thereof (i.e., left end in FIGS. 3 to 4E, which will simply be referred to as a "particular end" hereinafter). The upper reservoir 31 may be constituted by three channels, namely, an inflow channel 32*a*, an outflow channel 32*b*, and a connection channel 32*c*. The upper surface at the particular end of the upper reservoir body 30 may be provided with tubular joint portions 33 and 34 that protrude upward and are positioned adjacent to each other. The joint portions 33 and 34 may be respectively in communication with one end of the inflow channel 32*a* and one end of the outflow channel 32*b* in the extending direction thereof. Openings formed at the upper ends of the joint portions 33 and 34 may respectively function as the above-described ink supply port 42 and ink drain port 43. Moreover, the midsection of the upper reservoir body 30 may be provided with a connection port 31*a* that communicates with a channel provided therebelow.

The inflow channel 32*a* may be formed in a lower section of the upper reservoir body 30 in the thickness direction, i.e., the vertical direction thereof (which will simply be referred to as a "lower section" hereinafter), and may extend from the particular end to the midsection of the upper reservoir body 30. The outflow channel 32*b* may extend narrowly from the particular end to the midsection of the upper reservoir body 30. More specifically, one half of the outflow channel 32*b* closer towards the particular end may be formed in the lower section of the upper reservoir body 30, whereas the remaining half of the outflow channel 32*b* may be formed in an upper section of the upper reservoir body 30 in the thickness direction thereof (which will simply be referred to as an "upper section" hereinafter) and may extend downward at the midsection so as to merge with the inflow channel 32*a*. The connection channel 32*c* may connect to the merging point of the inflow channel 32*a* and the outflow channel 32*b*, may extend to the midsection in the upper section of the upper reservoir body 30, and then may extend downward to the connection port 31*a*.

One half of the inflow channel 32*a* closer towards the midsection substantially may have a parallelogram shape in plan view. This substantially parallelogram-shaped area of the inflow channel 32*a* may have a filter 44 positioned substantially in the middle of the inflow channel 32*a* as viewed in the thickness direction. This filter 44 may be configured to catch foreign matter contained in the ink that passes through it. The filter 44 may be flanked by spaces that function as filter chambers. In other words, a filter chamber in the inflow channel 32*a* may be divided by the filter 44 into an upstream filter chamber, closer towards the ink supply port 42, and a downstream filter chamber, closer towards the connection channel 32*c*. The outflow channel 32*b* may communicate with an end of the upstream filter chamber of the inflow channel 32*a*. Air bubbles may tend to remain in the upstream filter chamber. In this embodiment, the outflow channel 32*b* may be connected to the upstream filter chamber in which air bubbles tend to remain, whereby remnant air bubbles may be properly removed.

A flexible film 45 attached to the lower surface of the upper reservoir body 30 may function as a channel wall for the lower side of the inflow channel 32*a*. In other words, the inflow channel 32*a* may be exposed to ambient air through the film 45. Specifically, the lower surface of the upper reservoir body 30 and the upper surface of the lower reservoir body 35 may have a slight gap formed therebetween. Thus, when there is a pressure fluctuation in the upper reservoir 31, the film 45 may deform freely so as to absorb this pressure fluctuation. In other words, the film 45 may function as a damper. Furthermore, a film 46 attached to the lower surface of the upper reservoir body 30 may function as a channel wall for the lower side of the outflow channel 32*b*. Moreover, films 47 and 48 attached to the upper surface of the upper reservoir body 30 may function as channel walls for the upper side of the outflow channel 32*b* and the connection channel 32*c*, respectively. Like the film 45, the films 46, 47, and 48 may contribute to absorption of a pressure fluctuation.

Figure 4C:
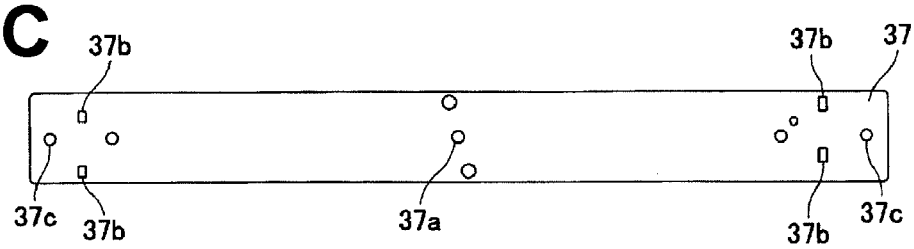
FIGS. 4C-4E are plan views of respective plates of a lower reservoir body, according to an embodiment of the disclosed subject matter.
Figure 4D:
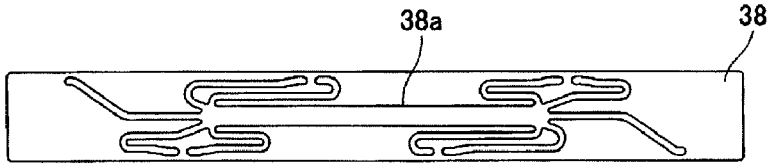
Figure 4E:
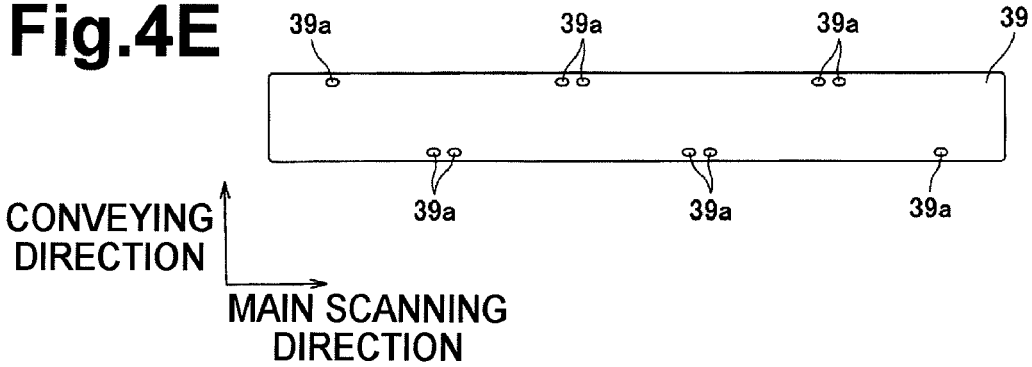

Referring to FIGS. 4C, 4D, and 4E, the plates 37 to 39 may be made of, for example, a metallic material such as stainless steel. Referring back to FIG. 3, the lower reservoir body 35 constituted by the stacked plates 37 to 39 may have a lower reservoir 36 formed therein, which functions as a channel that distributes the ink in the upper reservoir 31 to the channel unit 5.

Referring to FIG. 4C, the uppermost plate 37 of the plates 37 to 39 may have a through-hole (downward channel 37*a*) that communicates with the upper reservoir 31 via the connection port 31*a*. The longitudinal ends of the plate 37 may have a plurality of, e.g., two, openings 37*b* that are to be engaged with the claws 32 formed in the upper reservoir body 30. On the other hand, referring to FIGS. 4D and 6, the lowermost plate 39 may have a plurality of, e.g., ten, through-holes, e.g. communication channels 39*a*, that fluidly communicate with ink inflow ports 5*a* formed in the channel unit 5. Finally, the plate 38 positioned between the plate 37 and the plate 39 may have a hole, e.g., connection channel 38*a*, through which the downward channel 37*a* and the ten communication channels 39*a* communicate. Referring to FIG. 3, the downward channel 37*a*, the connection channel 38*a*, and the communication channels 39*a* may constitute the lower reservoir 36.

The length of the uppermost plate 37 in the longitudinal direction may be greater than those of the remaining plates 38 and 39 in the longitudinal direction. Thus, in the state where the plates 37 to 39 are stacked to form the lower reservoir body 35, the opposite ends of the plate 37 may protrude outward relative to the opposite ends of the plates 38 and 39. The protruding sections of the plate 37 may be respectively provided with through-holes 37*c*. These through-holes 37*c* may be used when attaching the inkjet head 100 to the printer.

The reservoir unit 3 may have the reservoir 41 formed therein, which comprises the upper reservoir 31 formed in the upper reservoir body 30 and the lower reservoir 36 formed in the lower reservoir body 35.

Figure 5:
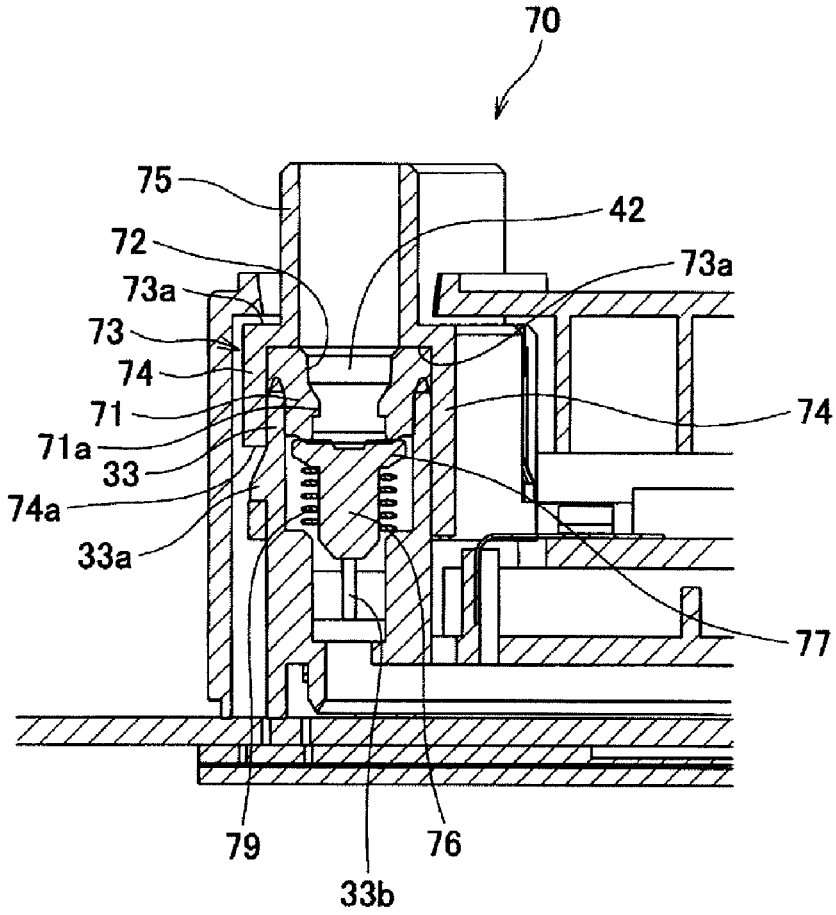
FIG. 5 is a partially enlarged cross-sectional view showing an ink supply port and its surrounding area in a main-body block according to an embodiment of the disclosed subject matter.

Referring to FIG. 2 and FIG. 5, the supply-valve mechanism 70 may be attached to the ink supply port 42 defined by the upper end of the joint portion 33, which communicates with the inflow channel 32*a*, of the joint portions 33 and 34 positioned adjacent to each other. The supply-valve mechanism 70 may include a communication member 71, a stationary member 73, a movable member 76, and a bias spring 79.

The communication member 71 may have a communication channel 72 extending from the inside of the joint portion 33 to the outside thereof via the ink supply port 42. The outside diameter at the lower end of the communication member 71 may be smaller than the inside diameter of the joint portion 33, whereas the outside diameter at the upper end of the communication member 71 may be larger than the inside diameter of the joint portion 33. The lower end of the communication member 71 may be fitted in the joint portion 33 by the stationary member 73, whereas the upper end of the communication member 71 may be secured to the joint portion 33 while protruding from the joint portion 33. The stationary member 73 may be a tubular member and may have a large-diameter section 74 having an inside diameter that is slightly larger than the outside diameter of the joint portion 33, a small-diameter section 75 having an inside diameter that is smaller than the outside diameter of the joint portion 33, and a connecting section 73*a* that connects the large-diameter section 74 and the small-diameter section 75. The stationary member 73 may be attached to the upper reservoir body 30 such that the joint portion 33 is fitted in the large-diameter section 74 with the communication member 71 interposed therebetween.

Referring to FIG. 5, the section of the communication member 71 that protrudes from the joint portion 33 may be sandwiched between the upper end of the joint portion 33 and the connecting section 73*a* of the stationary member 73. The joint portion 33 may have a projection 33*a* positioned on the outer surface thereof. The large-diameter section 74 of the stationary member 73 may have an opening 74*a* that is engaged with the projection 33*a*. The stationary member 73 may be fixed to the upper reservoir body 30 with the engagement between the projection 33*a* of the joint portion 33 and the opening 74*a* of the stationary member 73. Consequently, the communication member 71 may be secured to the joint portion 33 by the fixed stationary member 73.

A lower section of the joint portion 33 may have an inside diameter that is smaller than that of an upper section thereof. Furthermore, a guide pin 33*b* extending in the lengthwise direction of the joint portion 33 may be positioned inside the joint portion 33. The movable member 76 may be a columnar member having an outside diameter that is smaller than the inside diameter of the lower section of the joint portion 33. One end of the movable member 76 may be provided with a flange 77 having a diameter larger than both the inside diameter of the lower section of the joint portion 33 and the inside diameter at the lower end of the communication member 71. The movable member 76 may be positioned within the joint portion 33 with the flange 77 set in the upper position. Moreover, the movable member 76 may have a hole formed therein, which extends along an axis of the movable member 76 extending in the lengthwise direction thereof. The guide pin 33*b* may be fitted in this hole. Thus, the movable member 76 may be vertically movable along the guide pin 33*b* in the lengthwise direction of the joint portion 33. More specifically, the movable member 76 may be moved between two positions, namely, a seal position in which the flange 77 is in abutment with the lower end of the communication member 71 so as to seal the communication channel 72 and an open position in which the flange 77 is set apart from the communication member 71 so as to open the communication channel 72. In other words, when the movable member 76 is at the seal position, the ink supply port 42 may be sealed, whereas when at the open position, the ink supply port 42 may be open.

The bias spring 79 may be positioned in the upper section of the joint portion 33, which has a relatively large inside diameter, and may be configured to bias the flange 77 of the movable member 76 upward towards the seal position from below. Consequently, unless the movable member 76 is pressed in the opposite direction of the biasing direction of the bias spring 79, the supply-valve mechanism 70 may maintain the ink supply port 42 in a sealed state.

Similar to the supply-valve mechanism 70, the drain-valve mechanism 80 may include a communication member 81, a stationary member 83, a movable member 86, and a bias spring 89. The drain-valve mechanism 80 may be attached to the ink drain port 43 defined by the upper end of the joint portion 34. Referring back to FIG. 2, in this embodiment, the communication member 71 of the supply-valve mechanism 70 and the communication member 81 of the drain-valve mechanism 80 may be formed integrally, e.g., as a single-piece component. More specifically, the upper end of the communication member 71 that protrudes from the joint portion 33 and the upper end of the communication member 81 that protrudes from the joint portion 34 may be connected to each other. Similarly, the stationary member 73 of the supply-valve mechanism 70 and the stationary member 83 of the drain-valve mechanism 80 may be also formed as a single-piece component. More specifically, the large-diameter section 74 of the stationary member 73 and a large-diameter section 84 of the stationary member 83 may be connected to each other.

Referring to FIGS. 6 and 7, the channel unit 5 may have a rectangular shape in plan view and may have a plurality of, e.g., four, trapezoidal actuator units 6 arranged thereon in a zigzag pattern. An area on the lower surface of the channel unit 5 that corresponds to the actuator units 6 may be an ink ejection area including the plurality of nozzles 11. The upper surface of the channel unit 5 may have multiple pressure chambers 12 that fluidly communicate with the respective nozzles 11. Each of the actuator units 6 may be disposed so as to cover multiple pressure chambers 12.

Referring to FIG. 7, the channel unit 5 may have therein manifold channels 13 communicating with the ink inflow ports 5*a* formed in the upper surface of the channel unit 5, sub manifold channels 13*a* branching off from the manifold channels 13, and the individual ink channels 15 extending from outlets of the sub manifold channels 13*a* to the nozzles 11 via the pressure chambers 12. Thus, the ink from the reservoir unit 3 may be supplied to the manifold channels 13 via the ink inflow ports 5*a* and then distributed to the pressure chambers 12. When the actuator units 6 selectively apply pressure to a pressure chamber 12, the pressure of ink in the pressure chamber 12 may increase, causing the ink to be ejected from the nozzle 11 communicating with the pressure chamber 12.

The channel unit 5 may have a multilayer structure constituted by a cavity plate 51, a base plate 52, an aperture plate 53, a supply plate 54, manifold plates 55, 56, and 57, a cover plate 58, and a nozzle plate 59, which are stacked in that order from top to bottom. In other words, the ink ejection area may be positioned on the lower surface of the nozzle plate 59. The plates 51 to 59 may be made of, for example, a metallic material such as stainless steel.

These plates 51 to 59 may be positioned with respect to each other and stacked one on top of the other so as to form a common ink chamber, comprising, e.g., the manifold channels 13, and the sub manifold channels 13*a*, and the multiple individual ink channels 15 that extend from the outlets of the manifold channels 13 to the nozzles 11 via apertures 14 functioning as throttles and via the pressure chambers 12. The common ink chamber, pressure chambers 12, and the individual ink channels 15 may form an ink flow path, which places the nozzles 11 and the reservoir 41 in fluid communication.

Figure 8A:
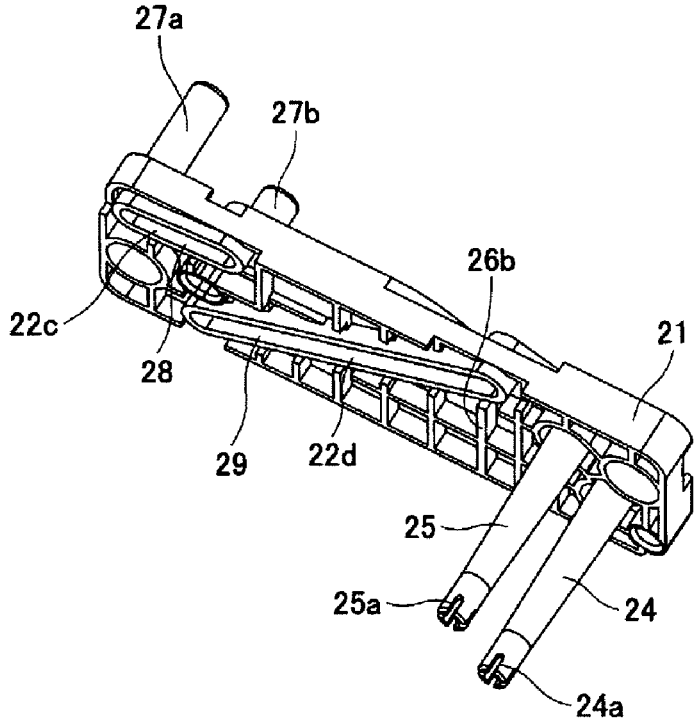
FIG. 8A is a perspective view of the attachment unit, as viewed at an angle from below according to an embodiment of the disclosed subject matter.
Figure 8B:
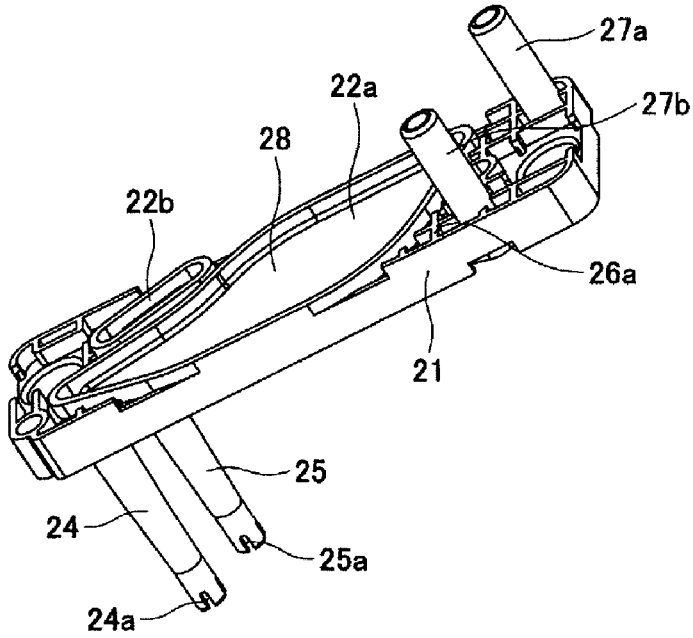
FIG. 8B is a perspective view of the attachment unit, as viewed at an angle from above according to an embodiment of the disclosed subject matter.
Figure 9A:
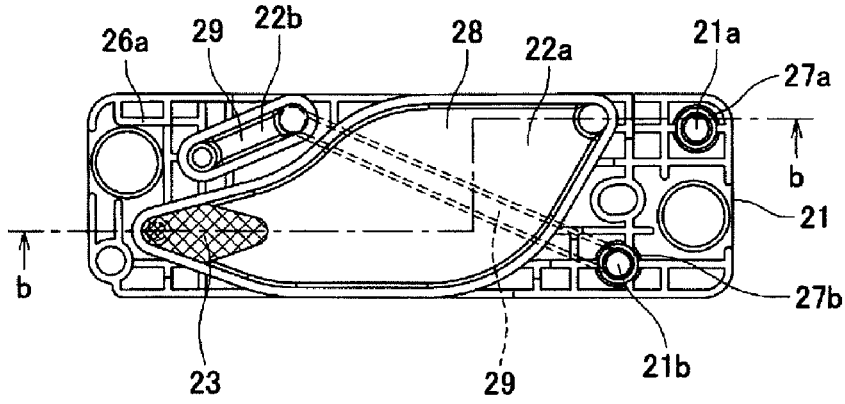
FIG. 9A is a top view of the attachment unit according to an embodiment of the disclosed subject matter.
Figure 9B:
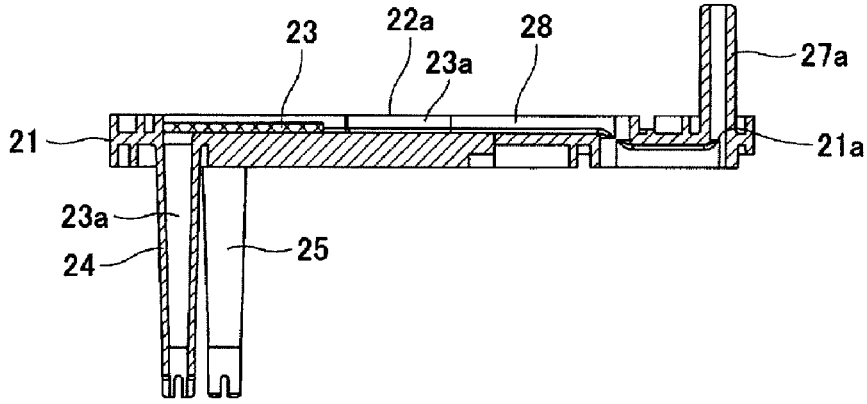
FIG. 9B is a cross-sectional view of the attachment unit according to an embodiment of the disclosed subject matter.
Figure 9C:
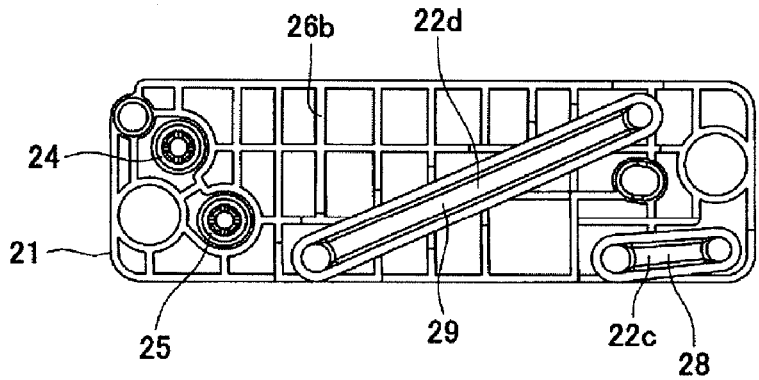
FIG. 9C is a bottom view of the attachment unit according to an embodiment of the disclosed subject matter.

Referring to FIGS. 8 and 9, a supply channel 28 through which ink to be sent to the ink supply port 42 of the reservoir unit 3 travels and a drainage channel 29 through which ink drained from the ink drain port 43 travels may be formed in the attachment unit 2. In addition, the attachment unit 2 may include a substantially tabular main body 21 having a rectangular shape in plan view and substantially tubular supply-valve opening member 24 and drain-valve opening member 25 that both protrude from the lower surface of the main body 21. Referring to FIG. 9B, the supply-valve opening member 24 and the drain-valve opening member 25 may protrude from the lower surface of the main body 21 by the same length. The supply channel 28 may be formed so as to extend from the inside of the supply-valve opening member 24 to the inside of the main body 21. Likewise, the drainage channel 29 may be formed so as to extend from the inside of the drain-valve opening member 25 to the inside of the main body 21.

The main body 21 may include an ink inlet 21*a* connected to the supply channel 28 and an ink outlet 21*b* connected to the drainage channel 29. The ink inlet 21*a* and the ink outlet 21*b* both may communicate with the space thereabove. The upper surface of the main body 21 may be provided with tubular joint portions 27*a* and 27*b* that protrude upward therefrom and respectively surround the ink inlet 21*a* and the ink outlet 21*b*. The joint portion 27*a* may be connected to a connection member that is coupled to an end of an ink supply tube (not shown) connected to an ink tank (not shown). Likewise, the joint portion 27*b* may be connected to a connection member that is coupled to an end of an ink return tube connected to the ink tank. Thus, the ink may circulate through the ink tank, the attachment unit 2, and the main-body block 1. This ink circulation may be implemented by a pump (not shown) disposed in the circulation channel system including the above-described configuration.

The supply channel 28 may extend from where it is connected to the supply-valve opening member 24 to the ink inlet 21*a* in the main body 21. Likewise, the drainage channel 29 may extend from where it is connected to the drain-valve opening member 25 to the ink outlet 21*b*. The supply channel 28 and the drainage channel 29 may be formed independently of each other.

The supply-valve opening member 24 and the drain-valve opening member 25 may be connected to one longitudinal end of the main body 21 in a manner such that they are spaced apart from each other in the widthwise direction of the main body 21. On the other hand, at the other longitudinal end of the main body 21, which is opposite to the end with the supply-valve opening member 24 and the drain-valve opening member 25 connected thereto, the ink inlet 21*a* and the ink outlet 21*b* may be positioned at positions spaced apart from each other in the widthwise direction of the main body 21. More specifically, as viewed in the widthwise direction of the main body 21, if one edge thereof adjacent to where the supply-valve opening member 24 is connected is defined as a "first edge" and the other edge opposite to the first edge and adjacent to where the drain-valve opening member 25 is connected is defined as a "second edge", the ink inlet 21*a* may be positioned adjacent to the second edge, whereas the ink outlet 21*b* may be positioned adjacent to the first edge. In other words, a line that connects the supply-valve opening member 24 and the ink inlet 21*a* and a line that connects the drain-valve opening member 25 and the ink outlet 21*b* may cross each other in plan view.

The supply channel 28 in the main body 21 may first extend from where it is connected to the supply-valve opening member 24 at the upper section of the main body 21 to an area near the ink inlet 21*a*. Then, the supply channel 28 may extend downward, and may finally extend through the lower section of the main body 21 to the ink inlet 21*a*. Referring to FIGS. 8B and 9A, an area of the supply channel 28 that is formed in the upper section of the main body 21 may extend wide to near the opposite edges of the main body 21 in the widthwise direction. On the other hand, the drainage channel 29 in the main body 21 may extend from where it is connected to the drain-valve opening member 25 at the upper surface of the main body 21 towards the second edge of the main body 21 at an angle with respect to the longitudinal direction of the main body 21. Then, the drainage channel 29 may extend downward, and may finally extend through the lower section of the main body 21 to the ink outlet 21*b*. Referring to FIG. 9A, the area of the supply channel 28 formed in the upper section of the main body 21 and an area of the drainage channel 29 that is formed in the lower section of the main body 21 (shown with a dashed line) may overlap each other in the vertical direction.

The area of the supply channel 28 formed in the upper section of the main body 21 may be partly defined by a flexible film 22*a* attached to the upper surface of the main body 21. Specifically, the film 22*a* may function as a channel wall for the upper side of the supply channel 28. The film 22*a* may have one face, i.e., upper face exposed to ambient air and the other face, i.e., lower face, in contact with the ink so as to isolate the ambient air and the ink from each other. When there is a drastic pressure fluctuation in the supply channel 28, the film 22*a* may function as a damper for absorbing the pressure fluctuation.

Similarly, a film 22*b* attached to the upper surface of the main body 21 may function as a channel wall for the upper side of an area of the drainage channel 29 formed in the upper section of the main body 21. Likewise, films 22*c* and 22*d* attached to the lower surface of the main body 21 may respectively function as a channel wall for the lower side of an area of the supply channel 28 formed in the lower section of the main body 21 and a channel wall for the lower side of the area of the drainage channel 29 formed in the lower section of the main body 21. Like the film 22*a*, the films 22*b*, 22*c*, and 22*d* may absorb pressure fluctuation.

Furthermore, the supply channel 28 in the main body 21 may have a filter 23 positioned at an end of the supply channel 28 adjacent to the supply-valve opening member 24. This filter 23 may be configured to catch foreign matter contained in the ink that passes through it. The filter 23 may be positioned downstream of the wider area of the supply channel 28. In other words, the supply channel 28 may include a filter chamber 23*a* that is divided by the filter 23 into an upstream filter chamber formed in the main body 21 and a downstream filter chamber formed in the supply-valve opening member 24. With this configuration, the area of the supply channel 28 formed in the upper section of the main body 21 may function both as a damper chamber and the filter chamber 23*a*.

Lattice-like ribs 26*a*, e.g., ribs that together form a structure similar in appearance to a lattice, may be positioned on the upper surface of the main body 21. Lattice-like ribs 26*b* may be positioned on the lower surface of the main body 21. These ribs 26*a* and 26*b* may enhance the rigidity of the attachment unit 2 and may inhibit deformation thereof. The films 22*a* to 22*d* may be fixed to the edges of annular projections positioned on the upper surface and the lower surface of the main body 21. The film 22*a* may be positioned over the wider area of the supply channel 28. This wider area may be surrounded by one of the annular projections and may have no ribs 26*a*. On the other hand, the annular projection for the drainage channel 29, which extends linearly, may be positioned at the lower surface of the main body 21 so as to extend crosswise across the wider area on the upper surface in plan view. Therefore, reduction in the rigidity of the attachment unit 2, which may be caused as the result of the formation of the channels, specifically, the formation of the wider area, may be reduced.

The supply-valve opening member 24 and the drain-valve opening member 25 both may have a tapered shape except for the tip sections thereof. The tip of the supply-valve opening member 24 may have a plurality of cutouts 24*a*, and likewise, the tip of the drain-valve opening member 25 may have a plurality of cutouts 25*a*. When attaching the attachment unit 2 to the main-body block 1, the supply-valve opening member 24 may press the movable member 76 of the supply-valve mechanism 70 downward, which is opposite to the biasing direction of the bias spring 79. The movable member 76 may be moved to the open position so that the supply-valve mechanism 70 is opened. Likewise, the drain-valve opening member 25 may press the movable member 86 of the drain-valve mechanism 80 downward, which is opposite to the biasing direction of the bias spring 89. The movable member 86 may be moved to the open position so that the drain-valve mechanism 80 is opened. Thus, the supply channel 28 of the attachment unit 2 may be brought into communication with the inflow channel 32*a* of the upper reservoir body 30 via the cutouts 24*a*, and the drainage channel 29 may be brought into communication with the outflow channel 32*b* via the cutouts 25*a*.

An opening and closing operation of the supply-valve mechanism 70 performed by the supply-valve opening member 24 will now be described with reference to FIGS. 10A and 10B. Since an opening and closing operation of the drain-valve mechanism 80 may be basically the same as the opening and closing operation of the supply-valve mechanism 70, the description thereof will be omitted here.

Figure 10A:
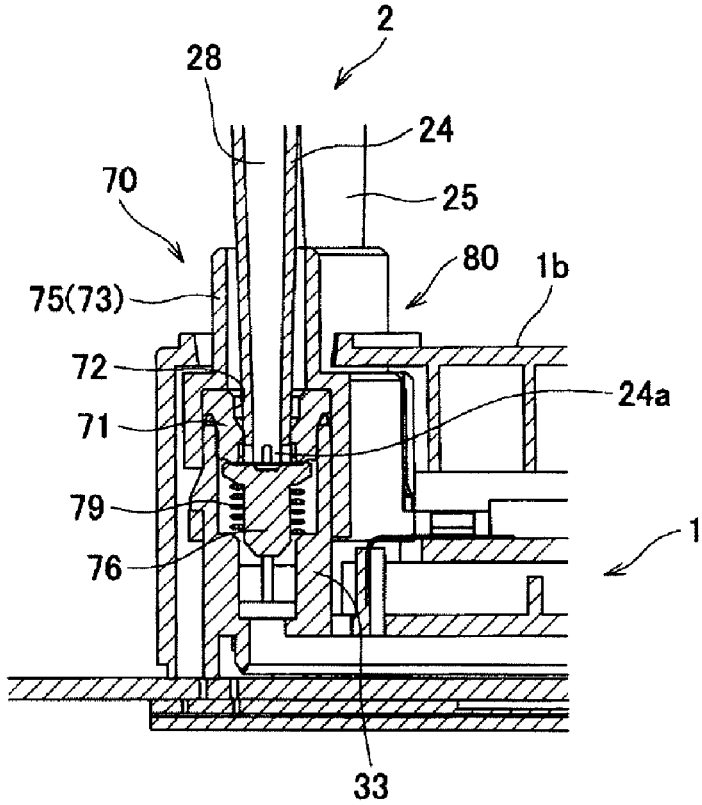
FIG. 10A illustrates a pre-opened state of the supply-valve mechanism according to an embodiment of the disclosed subject matter.
Figure 10B:
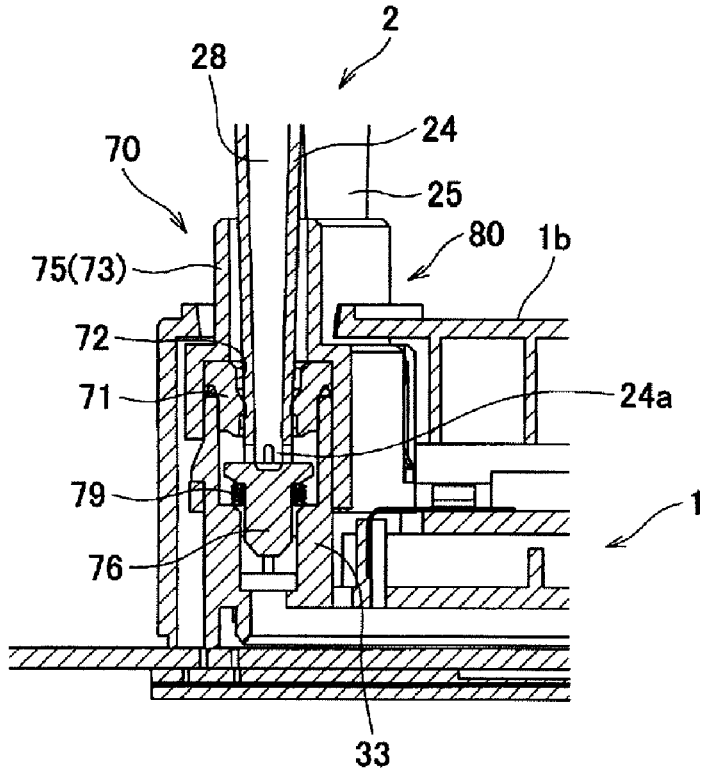
FIG. 10B illustrates an opened state of the supply-valve mechanism according to an embodiment of the disclosed subject matter.

Referring to FIG. 10A, when attaching the attachment unit 2 to the main-body block 1, the supply-valve opening member 24 may be first inserted into the small-diameter section 75 of the stationary member 73 and the communication channel 72 of the communication member 71 in the supply-valve mechanism 70. In this case, the tip of the supply-valve opening member 24 may be brought into abutment with the movable member 76 of the supply-valve mechanism 70. Then, the attachment unit 2 may be pressed downward so that the tip of the supply-valve opening member 24 presses the movable member 76 of the supply-valve mechanism 70 downward, which is opposite to the biasing direction of the bias spring 79. Thus, the movable member 76 may be moved from the seal position shown in FIG. 10A to the open position shown in FIG. 10B, whereby the supply-valve mechanism 70 is opened. Consequently, the ink in the supply channel 28 of the attachment unit 2 may flow into the joint portion 33 through the cutouts 24*a* at the tip of the supply-valve opening member 24.

Referring back to FIG. 5, the communication member 71 may have a ring-shaped projection 71*a* positioned at an intermediate position of the communication channel 72 and projected inward from the inner wall surface thereof. When the tip of the supply-valve opening member 24 is brought into abutment with the movable member 76, the ring-shaped projection 71*a* may come into contact with the outer surface of the supply-valve opening member 24. The communication member 71 may be made of a flexible resinous material, such as rubber, and may form a watertight seal when in contact with the supply-valve opening member 24. When the supply-valve opening member 24 is pressed further to cause backflow of ink through a gap between the communication member 71 and the movable member 76, the watertight seal may inhibit the ink from leaking to the outside.

As described above, the inkjet head 100 according to this embodiment may be provided with the attachment unit 2 detachably attached to the main-body block 1. The main-body block 1 may be provided with the ink supply port 42 that supplies ink to the reservoir 41. The attachment unit 2 may be provided with the supply channel 28 through which the ink to be sent to the ink supply port 42 travels. Moreover, the main-body block 1 may include the supply-valve mechanism 70 attached thereto, which may set the ink supply port 42 in a sealed state and an open state. When the attachment unit 2 is not attached to the main-body block 1, the supply-valve mechanism 70 may be configured to block the ink supply port 42, whereas when the attachment unit 2 is attached to the main-body block 1, the supply-valve mechanism 70 may be configured to open the ink supply port 42.

Therefore, the inkjet head 100 according to this embodiment may maintain the ink supply port 42 in a blocked state without requiring an additional component by simply detaching the attachment unit 2 from the main-body block 1. In addition, the ink supply port 42 may be set in an ink suppliable state by simply attaching the attachment unit 2 to the main-body block 1.

Furthermore, in the inkjet head 100 according to this embodiment, the main-body block 1 may be provided with the ink drain port 43 from which the ink in the reservoir 41 is drained. The attachment unit 2 may be provided with the drainage channel 29 through which the ink drained from the ink drain port 43 travels. Moreover, the main-body block 1 may include the drain-valve mechanism 80 attached thereto, which may set the ink drain port 43 in a sealed state and an open state. When the attachment unit 2 is not attached to the main-body block 1, the drain-valve mechanism 80 may be configured to block the ink drain port 43, whereas when the attachment unit 2 is attached to the main-body block 1, the drain-valve mechanism 80 may be configured to open the ink drain port 43.

Therefore, in the inkjet head 100 according to this embodiment, air bubbles inside the reservoir 41 of the main-body block 1 may be drained from the ink drain port 43 together with the ink. Moreover, the ink drain port 43 may be maintained in a sealed state by simply detaching the attachment unit 2 from the main-body block 1. In addition, the ink drain port 43 may be set in an ink drainable state by simply attaching the attachment unit 2 to the main-body block 1.

Furthermore, in the inkjet head 100 according to this embodiment, the supply-valve mechanism 70 may include the communication member 71 fixed to the main-body block 1 and having the communication channel 72 extending from the inside of the main-body block 1 to the outside thereof via the ink supply port 42, the movable member 76 movable between the seal position for sealing the communication channel 72 and the open position for opening the communication channel 72, and the bias spring 79 that biases the movable member 76 towards the seal position. Similar to the supply-valve mechanism 70, the drain-valve mechanism 80 may include the communication member 81, the movable member 86, and the bias spring 89. The attachment unit 2 may include the supply-valve opening member 24 and the drain-valve opening member 25 that are respectively fitted in the communication channels 72 and 82 when the attachment unit 2 is attached to the main-body block 1. The supply-valve opening member 24 and the drain-valve opening member 25 may respectively press the movable members 76 and 86 in a direction opposite to the biasing direction of the bias springs 79 and 89 so as to move the movable members 76 and 86 to the respective open positions.

Therefore, in the inkjet head 100 according to this embodiment, the sealing and opening operations of the ink supply port 42 and the ink drain port 43 may be readily performed without requiring complex devices, such as actuators, or complicated operations.

In addition, in the inkjet head 100 according to this embodiment, the stationary member 73 of the supply-valve mechanism 70 and the stationary member 83 of the drain-valve mechanism 80 may be formed as a single-piece component. In addition, the communication member 71 of the supply-valve mechanism 70 and the communication member 81 of the drain-valve mechanism 80 may be also formed as a single-piece component. Accordingly, the number of components may be reduced.

Furthermore, in the inkjet head 100 according to this embodiment, the channel wall for the upper side of the supply channel 28 in the main body 21 of the attachment unit 2 may be defined by the flexible film 22*a* whose upper face is exposed to ambient air and lower face is in contact with the ink so as to isolate the ambient air and the ink from each other. Moreover, the supply channel 28 may be provided with the filter 23. In other words, the supply channel 28 may have both a damping function and a filtering function. Consequently, in addition to the attachment unit 2 according to this embodiment, an attachment unit having only a damping function and an attachment unit having only a filtering function, for example, may be prepared so that a suitable attachment unit may be selectively used depending on the condition or purpose of use of the inkjet head 100.

A fluctuation of pressure applied to the inkjet head 100 may vary depending on the condition and purpose of use thereof. For this reason, the reservoir unit 3 in the inkjet head 100 according to this embodiment may be configured with both a filtering function and a damping function. The attachment unit 2 may be configured to function as a kind of a detachable reservoir unit. In other words, the inkjet head 100 according to this embodiment may be of a modifiable type in which a part of the reservoir unit is detachable. In this case, attachment units 2 having different functions may be prepared as described above, so that by selecting a suitable attachment unit for a basic inkjet head 100 having no attachment unit 2, an inkjet head that is suitable for various environments and purposes may be provided.

Furthermore, in the inkjet head 100 according to this embodiment, the supply channel 28 in the attachment unit 2 may include the filter chamber 23*a* that is divided by the filter 23 into the upstream filter chamber formed in the main body 21 and the downstream filter chamber formed in the supply-valve opening member 24. The channel wall for the upper side of the upstream filter chamber of the supply channel 28 in the main body 21 may be defined by the film 22*a*. Consequently, the attachment unit 2 may include a single liquid chamber functioning both as the filter chamber 23*a* in which the filter 23 is disposed and a damper chamber defined by the film 22*a*. Thus, the attachment unit 2 may have a compact structure.

Modifications of the above-described embodiment will now be described. A first modification may have a configuration that only allows for ink supply if the attachment unit is installed in the wrong orientation. A second modification may have a configuration that allows for ink circulation if the attachment unit is installed in the wrong orientation. Both modifications may have modified versions of the supply-valve opening member 24 and the drain-valve opening member 25 according to the above-described embodiment. The components that are the same as those in the above-described embodiment are given the same reference numerals and are not described in further detail.

Figure 11A:
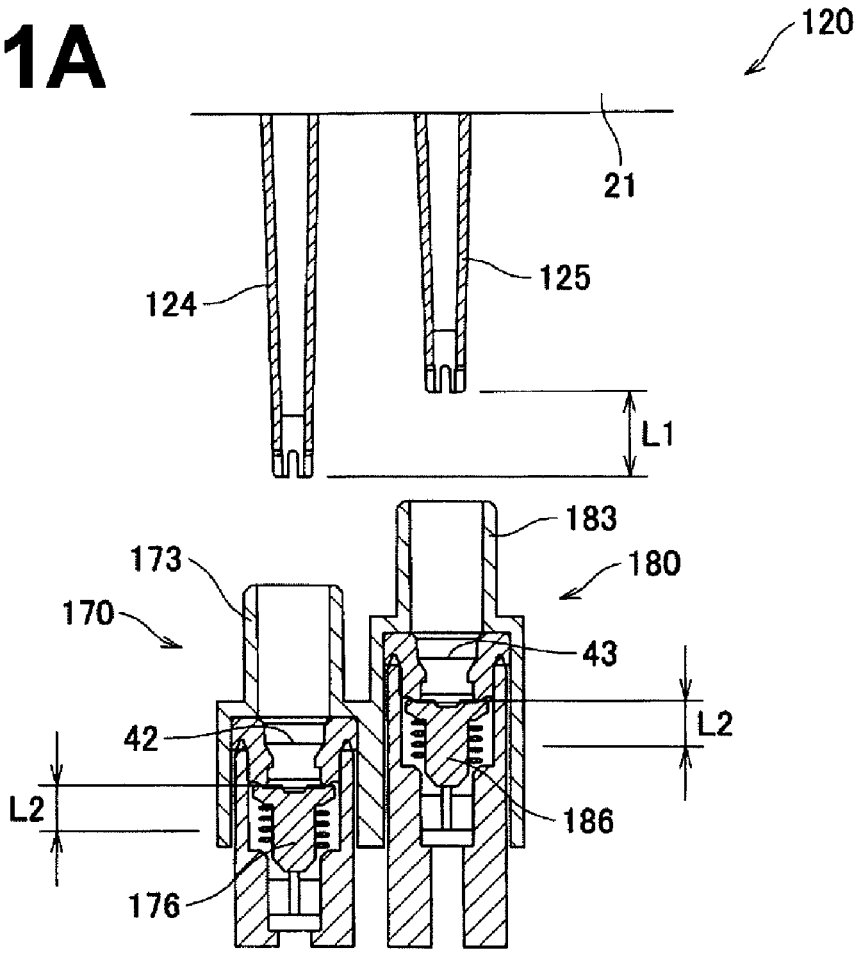
FIG. 11A is a partial cross-sectional view of an inkjet head according to a first modification of an embodiment of the disclosed subject matter.
Figure 11B:
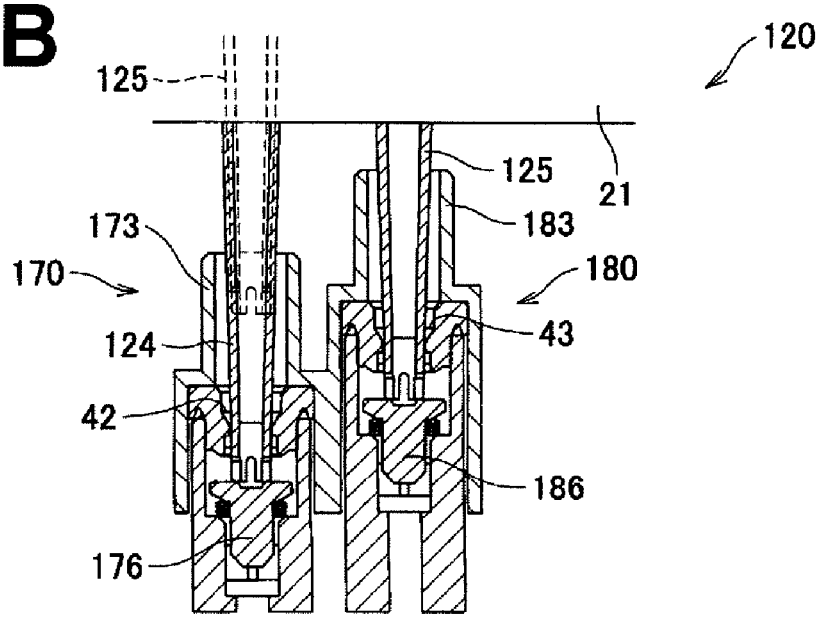
FIG. 11B is another partial cross-sectional view of an inkjet head according to a first modification of an embodiment of the disclosed subject matter.

Referring to FIGS. 11A and 11B, in the attachment unit 120 according to the first modification, the length of the supply-valve opening member 124 measured from the lower surface of the main body 21 to the tip of the supply-valve opening member 124 may be greater than the length of the drain-valve opening member 125 measured from the lower surface of the main body 21 to the tip of the drain-valve opening member 125. In other words, the supply-valve opening member 124 and the drain-valve opening member 125 in this embodiment may protrude from the lower surface of the main body 21 by different lengths. More specifically, a difference in lengths, indicated by L1 in FIG. 11A, of the supply-valve opening member 124 and the drain-valve opening member 125 may be equal to or greater than a distance, indicated by L2, between the seal position and the open position between which a movable member 176 of the supply-valve mechanism 170 and a movable member 186 of the drain-valve mechanism 180 move.

Similar to the inkjet head 100 according to the above-described embodiment, the inkjet head according to this modification may maintain the ink supply port 42 and the ink drain port 43 in a blocked state without requiring additional components by simply detaching the attachment unit 120 from the main-body block 1. In addition, the ink supply port 42 and the ink drain port 43 may be respectively set in an ink suppliable state and an ink drainable state by simply attaching the attachment unit 120 to the main-body block 1.

Furthermore, the difference L1 in lengths of the supply-valve opening member 124 and the drain-valve opening member 125 of the attachment unit 120 according to this modification may make it easier to visually recognize their positional relationship, thereby inhibiting the attachment unit 120 from being attached to the main-body block 1 in the wrong orientation. For more accurate installation of the attachment unit 120 in the proper orientation, the upper open ends of stationary members 173 and 183 may be set at different heights for the ink supply side and the ink drain side, respectively, as shown in FIGS. 11A and 11B. Furthermore, the length of the supply-valve opening member 124 measured from the lower surface of the main body 21 to the tip thereof may be greater than the length of the drain-valve opening member 125 measured from the lower surface of the main body 21 to the tip thereof. The difference L1 in the lengths may be greater than the distance L2 between the seal position and the open position between which the movable members 176 and 186 move. Therefore, ink may still be supplied at least to the reservoir 41 of the main-body block 1 even if the attachment unit 120 is installed in the wrong orientation, thereby allowing the inkjet head to perform a printing operation.

In other words, if the attachment unit 120 is installed in the wrong orientation such that the supply-valve opening member 124 is inserted in the drain-valve mechanism 180 and the drain-valve opening member 125 is inserted in the supply-valve mechanism 170, the movable member 186 of the drain-valve mechanism 180 may be moved to the open position by being pressed by the tip of the supply-valve opening member 124, thereby opening the drain-valve mechanism 180. In this state, the tip of the drain-valve opening member 125 may be at a position not in abutment with the movable member 176 of the supply-valve mechanism 170, as shown with a dashed line in FIG. 11B. This means that, in such a state, the drain-valve opening member 125 may be incapable of pressing the movable member 176.

Figure 12A:
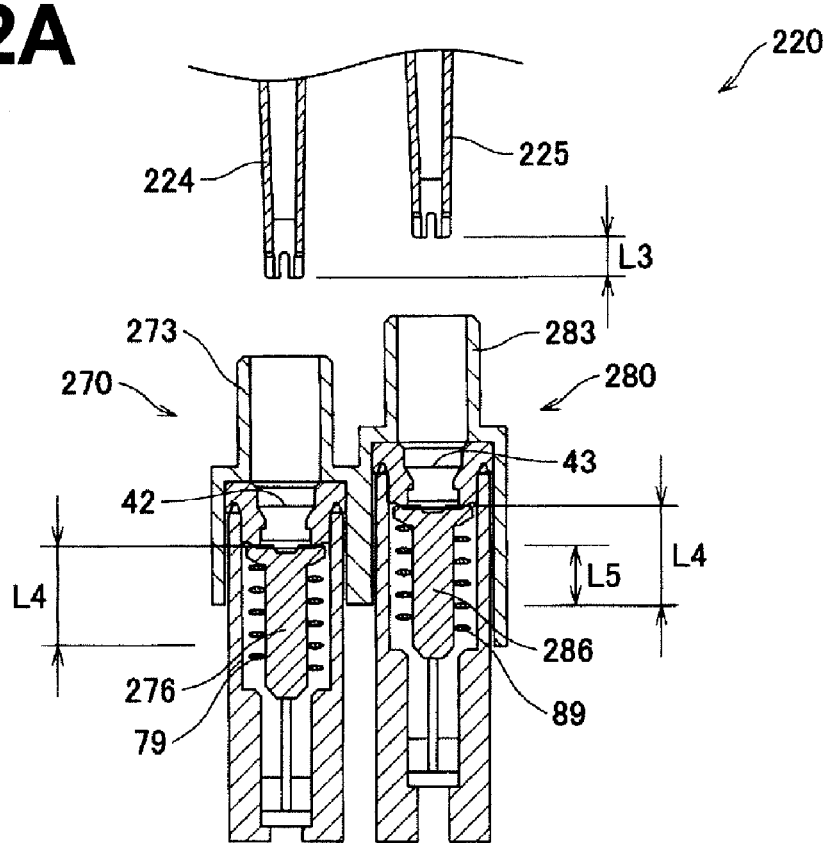
FIG. 12A is a partial cross-sectional view of an inkjet head according to a second modification of an embodiment of the disclosed subject matter.
Figure 12B:
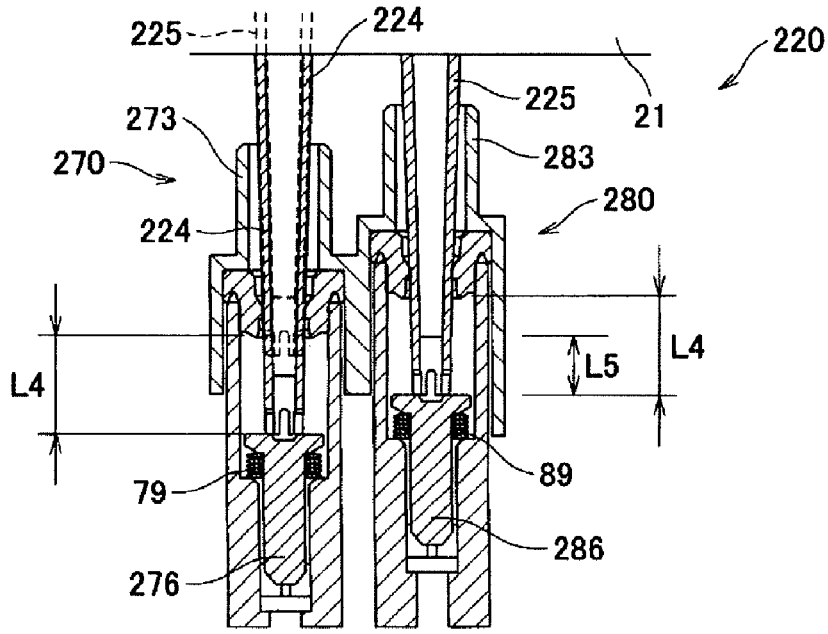
FIG. 12B is another partial cross-sectional view of an inkjet head according to a second modification of an embodiment of the disclosed subject matter.

Referring to FIGS. 12A and 12B, in the attachment unit 220 according to the second modification, the length of the supply-valve opening member 224 measured from the lower surface of the main body 21 to the tip of the supply-valve opening member 224 may be greater than the length of the drain-valve opening member 225 measured from the lower surface of the main body 21 to the tip of the drain-valve opening member 225. More specifically, a difference in lengths, indicated by L3 in FIG. 12A, of the supply-valve opening member 224 and the drain-valve opening member 225 may be smaller than a distance, indicated by L4, between the seal position and the open position between which a movable member 276 of the supply-valve mechanism 270 and a movable member 286 of the drain-valve mechanism 280 move. Therefore, when the tip of the drain-valve opening member 225 reaches the open position of the drain-valve mechanism 280, as shown in FIG. 12B, the tip of the supply-valve opening member 224 may be positioned lower relative to the open position of the drain-valve mechanism 280. Furthermore, the difference L3 in lengths may be smaller than a distance, indicated by L5 in FIGS. 12A and 12B, between the open position of the drain-valve mechanism 280 and the seal position of the supply-valve mechanism 270.

Similar to the inkjet head 100 according to the above-described embodiment, the inkjet head according to this modification may maintain the ink supply port 42 and the ink drain port 43 in a blocked state without requiring additional components by simply detaching the attachment unit 220 from the main-body block 1. In addition, the ink supply port 42 and the ink drain port 43 may be respectively set in an ink suppliable state and an ink drainable state by simply attaching the attachment unit 220 to the main-body block 1.

Furthermore, the difference L3 in lengths of the supply-valve opening member 224 and the drain-valve opening member 225 of the attachment unit 220 according to this modification may make it easier to visually recognize their positional relationship, thereby inhibiting the attachment unit 220 from being attached to the main-body block 1 in the wrong orientation. For more accurate installation of the attachment unit 220 in the proper orientation, the upper open ends of stationary members 273 and 283 may be set at different heights for the ink supply side and the ink drain side, respectively, as shown in FIGS. 12A and 12B. Furthermore, the difference L3 in lengths of the supply-valve opening member 224 and the drain-valve opening member 225 may be smaller than the distance L4 between the seal position and the open position between which the movable members 276 and 286 move and also smaller than the distance L5 between the open position of the drain-valve mechanism 280 and the seal position of the supply-valve mechanism 270. Therefore, the supply channel 28 and the drainage channel 29 of the attachment unit 220 may still be brought into communication with the reservoir 41 of the reservoir unit 3 even if the attachment unit 220 is installed in the wrong orientation.

In other words, if the attachment unit 220 is installed in the wrong orientation such that the supply-valve opening member 224 is inserted in the drain-valve mechanism 280 and the drain-valve opening member 225 is inserted in the supply-valve mechanism 270, the movable member 286 of the drain-valve mechanism 280 may be moved to the open position by being pressed by the tip of the supply-valve opening member 224, thereby opening the drain-valve mechanism 280. This increases the likelihood that a channel that connects the supply channel 28 of the attachment unit 220 and the reservoir 41 of the reservoir unit 3 may be established. In this state, the tip of the drain-valve opening member 225 may be positioned lower than the seal position of the supply-valve mechanism 270, as shown with a dashed line in FIG. 12B. In other words, the movable member 276 of the supply-valve mechanism 270 in this state may be pressed by the drain-valve opening member 225 in a direction opposite to the biasing direction of the bias spring 79. Consequently, although there is an increase in channel resistance as compared to when the attachment unit 220 is properly installed, a channel that connects the drainage channel 29 of the attachment unit 220 and the reservoir 41 of the reservoir unit 3 may be established.

In another embodiment of the invention, a structure incapable of draining the ink from the reservoir 41 may be used.

The above-described embodiments may be directed to examples in which the stationary member 73 of the supply-valve mechanism 70 and the stationary member 83 of the drain-valve mechanism 80 are formed as a single-piece component, and in which the communication member 71 of the supply-valve mechanism 70 and the communication member 81 of the drain-valve mechanism 80 are also formed as a single-piece component. Alternatively, the stationary members 73 and 83 and the communication members 71 and 81 may be separate components.

In some embodiments of the invention, the attachment unit 2 may have only one of the filtering function and the damping function, or may have none of these functions. Furthermore, a damping function may be provided in a part of the drainage channel 29. In addition, the filter chamber 23*a* and the damper chamber may be provided in separate liquid chambers.

In the first and second modifications described above, the length of the supply-valve opening member 124 or 224 measured from the lower surface of the main body 21 to the tip thereof may be greater than the length of the drain-valve opening member 125 or 225 measured from the lower surface of the main body 21 to the tip thereof. Alternatively, the length of the drain-valve opening member 125 or 225 measured from the lower surface of the main body 21 to the tip thereof may be greater than the length of the supply-valve opening member 124 or 224 measured from the lower surface of the main body 21 to the tip thereof.

While the disclosed subject matter has been described in connection with preferred embodiments, it will be understood by those of ordinary skill in the art that other variations and modifications of the preferred embodiments described above may be made without departing from the scope of the present invention. Other embodiments will be apparent to those skilled in the art from a consideration of the specification or practice of the disclosed subject matter herein. It is intended that the specification and the described examples only are considered as exemplary of the disclosed subject matter, with the true scope of the disclosed subject matter being defined by the following claims.

What is claimed is:

1. An inkjet head comprising:

a main-body block comprising a reservoir configured to store ink;

an ink supply port configured to supply the ink to the reservoir; and a plurality of nozzles in fluid communication with the reservoir via an ink flow path;

a supply valve mechanism attached to the main-body block and configured to selectively set the ink supply port in one of a sealed state and an open state; and an attachment unit configured to be removably attached to the main-body block and comprising a supply channel configured to supply the ink to the ink supply port, wherein a portion of the attachment unit separates from the supply valve mechanism and the supply valve mechanism sets the ink supply port in the sealed state when the attachment unit is detached from the main-body block, and the portion of the attachment contacts the supply valve mechanism and the supply valve mechanism sets the ink supply port in the open state when the attachment unit is attached to the main-body block.

2. The inkjet head according to claim 1, wherein the ink flow path comprises a common ink chamber in fluid communication with the reservoir, and a plurality of individual ink channels extending from an outlet of the common ink chamber to the plurality of nozzles via a pressure chamber.

3. The inkjet head according to claim 1, wherein the supply valve mechanism comprises:

a particular communication member attached to the main-body block and having a particular communication channel formed therein, the particular communication channel extending from an interior of the main-body block to an exterior of the main-body block;

a particular movable member configured to selectively move between a particular seal position and a particular open position, wherein when the particular movable member is in the particular seal position, the particular movable member seals an end of the particular communication channel, and when the particular movable member is in a particular open position, the particular end of the particular communication channel is open; and a particular biasing member configured to bias the particular movable member towards the particular seal position.

4. The inkjet head according to claim 3, wherein the attachment unit further comprises a supply valve opening member configured to be inserted into the particular communication channel and to press the particular movable member in a direction opposite to a biasing direction of the particular biasing member when the attachment unit is attached to the main-body block.

5. The inkjet head according to claim 1, wherein at least a portion of the supply channel is defined by a film comprising a first face and a second face opposite the first face, wherein the first face contacts the ink.

6. The inkjet head according to claim 5, wherein the supply channel further comprises:

a filter, wherein the filter defines a least a portion of an upstream chamber and a downstream chamber formed in the supply chamber; and wherein the film encloses at least one of the upstream channel and the downstream channel.

7. The inkjet head according to claim 1, wherein the supply channel further comprises a filter.

8. An inkjet head comprising:

a main-body block comprising:

a reservoir configured to store ink;

an ink drain port configured to drain the ink from the reservoir; and a plurality of nozzles in fluid communication with the reservoir via an ink flow path;

a drain valve mechanism attached directly to the main-body block and configured to selectively set the ink drain port in one of a sealed state and an open state; and an attachment unit configured to be removably attached to the main-body block and comprising a drainage channel configured to drain the ink from the ink drain port, wherein the drain valve mechanism sets the ink drain port in the sealed state when the attachment unit is detached from the main-body block, and sets the ink drain port in the open state when the attachment unit is attached to the main-body block.

9. The inkjet head according to claim 8, wherein the ink flow path comprises a common ink chamber in fluid communication with the reservoir, and a plurality of individual ink channels extending from an outlet of the common ink chamber to the plurality of nozzles via a pressure chamber.

10. The inkjet head according to claim 8, wherein at least a portion of the drainage channel is defined by a film comprising a first face and a second face opposite the first face, wherein the first face contacts the ink.

11. The inkjet head according to claim 8, wherein the drain valve mechanism comprises:

a further communication member attached to the main-body block and having a further communication channel formed therein, the further communication channel extending from an interior of the main-body block to an exterior of the main-body block;

a further movable member configured to selectively move between a further seal position and a further open position, wherein when the further movable member is in the further seal position, the further movable member seals an end of the further communication channel, and when the further movable member is in a further open position, the further end of the further communication channel is open; and a further biasing member configured to bias the further movable member towards the further seal position.

12. The inkjet head according to claim 11, wherein the attachment unit further comprises a drain valve opening member configured to be inserted into the further communication channel and to press the further movable member in a direction opposite to a biasing direction of the further biasing member when the attachment unit is attached to the main-body block.

13. An inkjet head comprising:

a main-body block comprising:

a reservoir configured to store ink;

an ink supply port configured to supply the ink to the reservoir;

an ink drain port configured to drain the ink from the reservoir; and a plurality of nozzles in fluid communication with the reservoir via an ink flow path;

a supply valve mechanism attached to the main-body block and configured to selectively set the ink supply port in one of a sealed state and an open state;

a drain valve mechanism attached to the main-body block and configured to selectively set the ink drain port in one of a sealed state and an open state; and an attachment unit configured to be removably attached to the main-body block and comprising a supply channel configured to supply the ink to the ink supply port and a drainage channel configured to drain the ink from the ink drain port, wherein when the attachment unit is detached from the main-body block, the supply valve mechanism sets the ink supply port in the sealed state and the drain valve mechanism sets the ink drain port in the sealed state, and when the attachment unit is attached to the main-body block, the supply valve mechanism sets the ink supply port in the open state and the drain valve mechanism sets the ink drain port in the open state.

14. The inkjet head according to claim 13, wherein the ink flow path comprises a common ink chamber in fluid communication with the reservoir, and a plurality of individual ink channels extending from an outlet of the common ink chamber to the plurality of nozzles via a pressure chamber.

15. The inkjet head according to claim 13, wherein at least a portion of the supply channel and the drainage channel is defined by a film comprising a first face and a second face opposite the first face, wherein the first face contacts the ink.

16. The inkjet head according to claim 13, wherein the supply valve mechanism comprises:

a particular communication member attached to the main-body block and having a particular communication channel formed therein, the particular communication channel extending from an interior of the main-body block to an exterior of the main-body block;

a particular movable member configured to selectively move between a particular seal position and a particular open position, wherein when the particular movable member is in the particular seal position, the particular movable member seals an end of the particular communication channel, and when the particular movable member is in a particular open position, the particular end of the particular communication channel is open; and a particular biasing member configured to bias the particular movable member towards the particular seal position; and wherein the drain valve mechanism comprises:

a further communication member attached to the main-body block and having a further communication channel formed therein, the further communication channel extending from an interior of the main-body block to an exterior of the main-body block;

a further movable member configured to selectively move between a further seal position and a further open position, wherein when the further movable member is in the further seal position, the further movable member seals an end of the further communication channel, and when the further movable member is in a further open position, the further end of the further communication channel is open; and a further biasing member configured to bias the further movable member towards the further seal position.

17. The inkjet head according to claim 16, wherein the attachment unit further comprises:

a supply valve opening member configured to be inserted into the particular communication channel and to press the particular movable member in a direction opposite to a biasing direction of the particular biasing member when the attachment unit is attached to the main-body block; and a drain valve opening member configured to be inserted into the further communication channel and to press the further movable member in a direction opposite to a biasing direction of the further biasing member when the attachment unit is attached to the main-body block.

18. The inkjet head according to claim 17, wherein the attachment unit further comprises a main body, wherein the supply channel and the drainage channel are integrally formed with the main body;

wherein the supply-valve opening member and the drain-valve opening member extend from a surface of the main body; and wherein a distance from the surface of the main body to a tip of the supply-valve opening member differs from a distance from the surface of the main body to a tip of the drain-valve opening member by a predetermined length.

19. The inkjet head according to claim 18, wherein the distance from the surface of the main body to the tip of the supply-valve opening member is greater than the distance from the surface of the main body to the tip of the drain-valve opening member.

20. The inkjet head according to claim 19, wherein the predetermined length is less than a distance between the particular movable member at the particular seal position and the particular movable member at the particular open position and less than a distance between the further movable member at the further open position and the particular movable member at the particular seal position, in the biasing direction.

21. The inkjet head according to claim 16, wherein the particular communication member is integrally formed with the further communication member.

* * * * *